United States Patent [19]

Clark

[11] 3,978,595

[45] Sept. 7, 1976

[54] ANTI-SKID ATTACHMENT FOR SHOES

[75] Inventor: Pauline Carlisle Clark, Westbury, N.Y.

[73] Assignee: Lawrence Peska Associates, Inc., New York, N.Y. ; a part interest

[22] Filed: Aug. 4, 1975

[21] Appl. No.: 601,812

[52] U.S. Cl. ..... 36/7.7; 36/135

[51] Int. Cl.[2] ..... A43B 3/18

[58] Field of Search ..... 36/7.7, 7.6, 2.5 AN

[56] References Cited

UNITED STATES PATENTS 2,656,957 10/1953 Bloch ..... 36/7.7

2,839,845 6/1958 Burton ..... 36/7.7

*Primary Examiner*—Patrick D. Lawson

*Attorney, Agent, or Firm*—Richard E. Nanfeldt

[57] ABSTRACT

An anti-skid attachment for shoes includes a member having the contour of the underside of the front of the shoes and receiving same; means for removably securing the body to the shoes; a plurality of spikes or cleats depending from the body; front and side plastic flaps hingedly secured to the body and adapted to be moved from an upper or inoperative, perpendicular position to an operative position parallel to the bottom of the body and at least partially covering the spikes or cleats to avoid scratching surfaces walked on.

4 Claims, 3 Drawing Figures

ANTI-SKID ATTACHMENT FOR SHOES

BACKGROUND OF THE INVENTION

1. Field of Invention

This invention relates to anti-skid attachments for footwear.

More particularly, this invention relates to an attachment for shoes having non-skid elements for walking on slippery surfaces and means for covering such elements for walking on ordinary surfaces.

2. Description of Prior Art

The prior art to which this invention relates is already aware of U.S. Pat. Nos.: 2,776,499; 2,222,650; 2,658,289 and 3,170,251. The attachments therein disclosed either are not designed for walking on ordinary surfaces or else require structures of a complexity not warranted by the selling price such articles can command.

The main object of this invention is to provide an anti-skid attachment for shoes which easily can be made inoperative for walking on ordinary surfaces and especially designed for heavy persons.

In the accompanying drawing, in which is shown one of the various possible illustrative embodiments of this invention, wherein like reference character identify the same or like parts:

Figure 1:
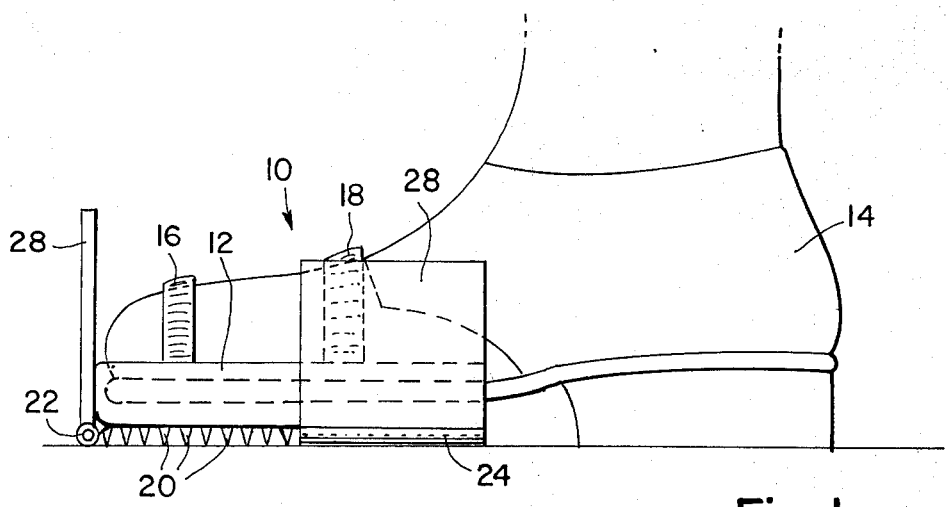
FIG. 1 is a perspective view, partly in section, showing a shoe equipped with the attachment of the invention.

With reference to the drawing, there is shown and illustrated an anti-skid attachment constructed in accordance with the principles of the invention and designated generally by reference character 10.

As shown, the attachment comprises plastic, rubber or leather body 12 conforming to the shape of the front of footwear or shoe 14; and of a shape and size such as to fit around the bottom thereof. Straps 16 and 18 which may be extensible or adjustable by means of buckles (not shown) or the like, which fit around the top of the shoe, secure the attachment to the shoe.

Protruding from the bottom of body 12 are a plurality of rows of spikes, studs, or cleats 20 for giving traction when walking on a soft or slippery surface.

To avoid removing the anti-slip attachment when walking indoors or on other normal surfaces, the present attachment is provided with means for rendering the gripping means 20 inoperative. In essence, these consist of masking means which may be folded over the rows of spikes.

Figure 2:
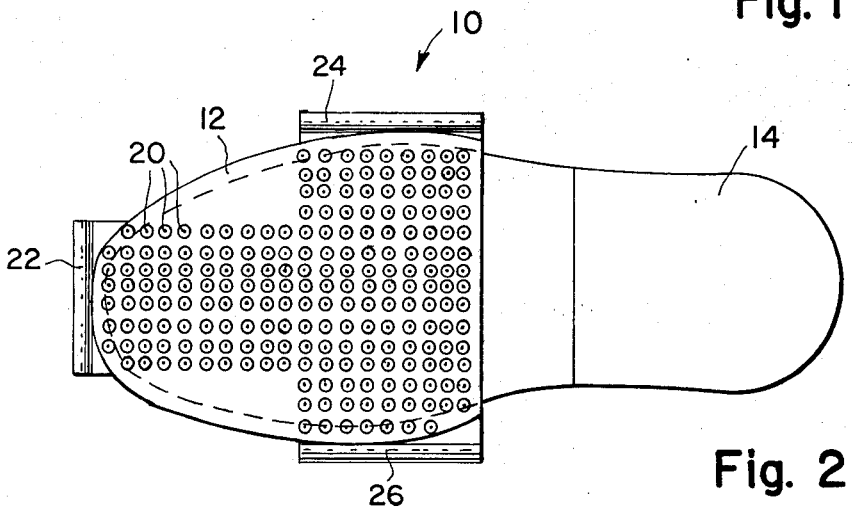
FIG. 2 is a bottom view of the same with the attachment shown in operative position for walking on slippery surfaces.

As shown on FIG. 2, the rows of spikes do not protrude from the whole of the bottom of body 12 but form a cross-shaped (or other patter) area on part thereof.

Secured to the sides and the front of the body 12 are locking spring hinges 22, 24 and 26 located substantially within the plane of spikes 20 but in such a way as not to interfere with walking. Secured to these hinges, are square or rectangular hard plastic, "Corfam", rubber, or leather, flaps 28 which are so dimensioned and shaped as to cover spikes 20, as shown on FIG. 3.

Thus in accordance with the invention it is possible to mask or cover the anti-slip means when these are not needed.

The attachment of the invention suitably is made in different shapes to fit men's , women's and children's shoes; and in small, medium and large sizes.

Figure 3:
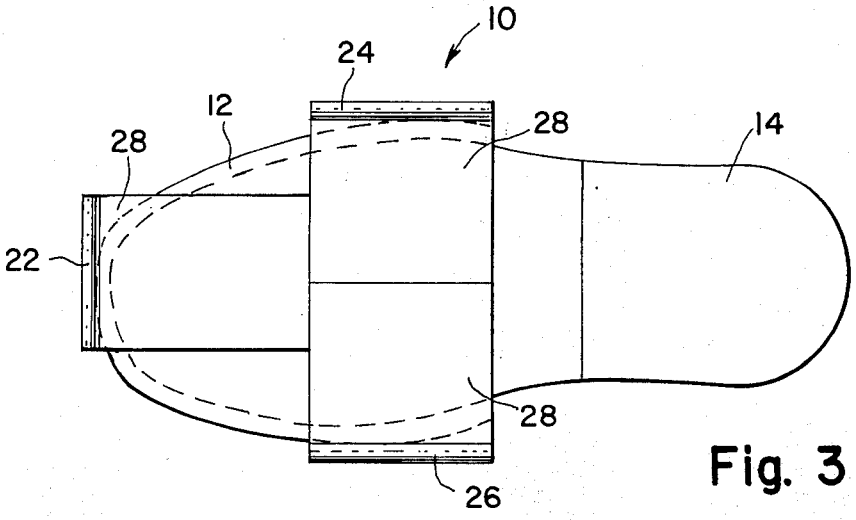
FIG. 3 is a bottom view showing the device in inoperative position for walking on ordinary surfaces.

To make sure the flaps when in the position shown in FIG. 3 do not hang down from the shoes between steps they should be made of a material in which the spikes will penetrate and adhere such as those mentioned above. Ensuring that the hinges are stiff will also contribute to stability.

The operation and use of the invention hereinabove described will be evident to those skilled in the art to which it relates from a consideration of the foregoing.

It will thus be seen that there is provided a device in which the several objects of this invention are achieved, and which is well adapted to meet the conditions of practical use.

As various possible embodiments might be made of the above invention, and as various changes might be made in the embodiment above set forth, it is to be understood that all matter herein set forth or shown in the accompanying drawing is to be interpreted as illustrative and not in a limiting sense.

Having thus described my invention, what is claimed as new is:

1. An anti-skid attachment for shoes and the like, comprising: a body conforming in shape to the front part of a shoe and receiving same therein; means for removably securing said body to said front part, said body having a lower surface partially provided with rows of anti-skid means protruding therefrom for gripping slippery surfaces; and masking means hinged to the sides and front of said body and adapted to swing from a vertical position to a horizontal position in which said means are held against anti-skid means for rendering same inoperative for walking on ordinary surfaces.

2. The device of claim 1, wherein said masking means consist of flaps of material penetratable by said anti-skid means for holding said flaps against the bottom of said shoe.

3. The device of claim 1, wherein said anti-skid means consist of rows of spikes arranged in a cross-shaped configuration.

4. The device of claim 2, wherein said flaps are rectangular.

* * * * *